United States Patent [19]

Smith

[11] Patent Number: 5,065,731

[45] Date of Patent: Nov. 19, 1991

[54] ARROW REST ASSEMBLY

[75] Inventor: Bill Smith, Talcum, Ky.

[73] Assignee: Smith Brothers Archery Accessories, Inc, Leburn, Ky.

[21] Appl. No.: 555,836

[22] Filed: Jul. 23, 1990

[51] Int. Cl.[5] ..... F41B 5/00

[52] U.S. Cl. ..... 124/44.5; 124/24.1

[58] Field of Search ..... 124/24.1, 44.5, 23.1

[56] References Cited

U.S. PATENT DOCUMENTS

| | | | |
|---|---|---|---|
| 3,108,584 | 10/1963 | Coe | 124/24.1 |
| 4,398,528 | 8/1983 | Troncoso, Jr. | 124/24.1 |
| 4,476,846 | 10/1984 | Carville | 124/44.5 |
| 4,664,093 | 5/1987 | Nunemaker | 124/24.1 |
| 4,686,956 | 8/1987 | Troncoso, Jr. | 124/44.5 |
| 4,827,895 | 5/1989 | Troncoso, Jr. | 124/44.5 |
| 4,838,237 | 6/1989 | Cliburn | 124/24.1 X |
| 4,899,716 | 2/1990 | Martin et al. | 124/44.5 |
| 4,917,072 | 4/1990 | Chang | 124/24.1 X |
| 4,947,823 | 8/1990 | Larson | 124/24.1 X |

OTHER PUBLICATIONS

Bowhunters Discount Warehouse, Inc., Catalog, Summer Edition 1990, on pp. 44, 46.

Bowhunters Discount Warehouse, Inc. Catalog, Summer Edition 1990, on page 46.

*Primary Examiner*—Peter M. Cuomo

*Assistant Examiner*—Jeffrey L. Thompson

*Attorney, Agent, or Firm*—King and Schickli

[57] ABSTRACT

An arrow rest assembly includes a mounting bracket for mounting to a bow. A rest arm is mounted on a spatially fixed lateral shaft that aids in supporting and positioning the rest arm. The rest arm is adapted to be laterally adjusted along the shaft. The assembly further includes an angular adjustment screw that cooperates with the rest arm to angularly position the arrow supported by the rest arm for proper flight trajectory upon firing. In one embodiment, the lateral shaft is threaded to mate with a threaded hole in the rest arm. A lateral adjustment knob is rotated to rotate the shaft and thus move the rest arm laterally along the shaft due to the cooperating threaded engagement. The angular adjustment screw is atached directly to the rest arm and engages a bottom plate of the assembly. In another embodiment, the lateral shaft has a V-shaped slot for receiving a securing screw attached to the rest arm. An elevation adjustment arm is attached to the shaft and pivotably engages the elevation adjustment screw. The shaft and rest arm thus rotate in response to the pivotal motion of the elevation adjustment arm. A biasing spring urges the rest arm back to an established support position when it deflects away from the arrow flight path following release from the bowstring.

12 Claims, 2 Drawing Sheets

ARROW REST ASSEMBLY

TECHNICAL FIELD

The present invention relates generally to archery equipment and more particularly to an assembly for supporting an arrow in preparation for firing by a bow.

BACKGROUND OF THE INVENTION

Interest in archery as a recreational activity has grown dramatically in recent years. It has long been a method used in game hunting. It can be appreciated that in order to optimize the use of an archer's arrows, accuracy is extremely important in felling the game animal. More recently, target shooting has developed into a popular sports competition where again accuracy is at a premium. Accordingly, there has been a continuing need to develop structures that provide consistent support and control of an arrow prior to bowstring release. Such structures must respond easily and efficiently to minute adjustments to improve accuracy.

One feature used by archers to bring about such a result is an arrow rest that is mounted to the bow. The arrow rest aids in consistently and steadily supporting an arrow as it is being prepared for launching. The arrow rest is adapted to establish a repeatable firing position that leads to substantial repeatability in an arrow's flight path.

Examples of arrow rests of this type are disclosed in U.S. Pat. No. 4,476,846 to Carville; and U.S. Pat. No. 4,827,895, 4,686,956 and 4,398,528, all to Troncoso, Jr. The Carville arrow rest allows for a rest arm to be laterally adjusted relative to the bow by rotating a threaded nut that engages a threaded shaft supporting the rest arm. However, angular positioning of the arrow rest for establishing the flight trajectory of an arrow is accomplished by a relatively complicated manual adjustment. More specifically, a set screw must be loosened, a block rotated the desired amount to effect the angular orientation of the arrow and then the set screw retightened while the block is held in position. Such a procedure is inconvenient and, unless a steady hand is used, often inaccurate.

The Troncoso rests function to prevent arrow roll-off while steadily supporting the arrow in preparation for firing. Further, all of the Troncoso rests also require relatively complicated manual manipulation for angular adjustment of the arrow rest. More particularly, as with the Carville rest, a set screw must be released, a structure carefully manipulated and the set screw retightened while the manipulated structure is held in position in order to complete any angular adjustment.

It can be appreciated that while incremental lateral adjustment relative to the bow as provided by the Carville arrow rest is important in improving accuracy, it only partly accomplishes the desired position control. More particularly, lateral adjustment only allows the archer to compensate for cross winds and not distance. Accordingly, there is a need to provide a mechanism associated with an arrow rest that allows for simple, convenient, positive and precise control for positioning an arrow to bring about the desired flight trajectory upon launching. In this way, an archer may readily compensate for head winds, tail winds and changes in target distances as may often be encountered.

SUMMARY OF THE INVENTION

Accordingly, it is a primary object of the present invention to provide an arrow rest assembly that overcomes the above-described limitations and disadvantages of the prior art.

One object of the present invention is to provide an arrow rest assembly of simple, relatively inexpensive construction that is totally reversible for use on left handed or right handed bows.

It is an additional object of the present invention to provide an arrow rest assembly that is of sturdy construction to resist inadvertent impact damage and hence, a long service life.

It is another object of the present invention to provide an arrow rest assembly that allows incremental angular adjustment in combination with incremental lateral adjustment to provide precise arrow positioning for improved shooting accuracy under substantially any conditions.

Still another object of the present invention is to provide an arrow rest assembly whose angular adjustment is accomplished incrementally by an elevation adjustment screw.

Another object of the present invention is to provide an arrow rest assembly having a rest arm that is securely positioned when the arrow is ready for release and deflects away substantially simultaneously upon release so as to avoid impeding arrow flight. Additionally, structure is provided for urging the rest arm back to an established support position following firing.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing ant other objects, and in accordance with the purposes of the present invention as described herein, an improved arrow rest assembly for use with a bow is disclosed. The assembly includes a bracket for mounting on the bow. The bracket has a longitudinal slot for adjustably positioning the bracket along the bow sidewall.

A rest arm is provided to support an arrow and hold it in a steady position for firing. The rest arm is attached to a spatially fixed lateral shaft that extends between the assembly mounting bracket and a shaft mounting bracket. The rest arm is adapted to be laterally adjusted and securely positioned along the shaft. This provides the desired horizontal adjustment necessary to allow for cross wind compensation and thereby provide greater shooting accuracy.

It should also be appreciated that the trajectory of an arrow in flight is extremely important, especially when shooting at a substantial distance. A slight adjustment in the angular orientation of the arrow results in a substantial change in flight trajectory and thus impact point. Thus, the ability to incrementally adjust the elevational position and angular orientation of the arm is of extreme importance in precision and accuracy. Accordingly, in an important aspect of the invention, an elevation adjustment screw is provided to incrementally adjust and precisely position the rest arm at the appropriate angle relative to the bow to bring about the desired flight trajectory.

Once the rest arm is laterally and angularly positioned, it remains steady and immobile as it holds the arrow in preparation for firing. It does, however, have sufficient mounting freedom to deflect away substantially simultaneously with the arrow release. Thus, the rest arm does not significantly interfere with the flight path of the arrow by engaging the fletching of the arrow. Following a shot, a biasing spring assists in urging the rest arm back to its established support position in preparation for the next arrow.

In one embodiment, the rest arm has a longitudinally projecting base that rotatably receives the angular elevational adjustment screw. An angularly upwardly extending projection is integral with the base and provides the arrow engaging surface. A threaded hole is provided laterally through the rest arm at the convergence of the base and projection.

In this embodiment, the lateral shaft is externally threaded to engage and mate with the threaded hole in the rest arm. A slot extends from the hole to the edge of the arm directed away from the base and projection. A securing screw connects the portions of the arm straddling the slot and upon manipulation adjusts the degree of engagement between the hole and shaft. An adjustment knob is attached to the shaft at its end adjacent the bow sidewall. As stated above, the shaft is spatially fixed so that rotation of the adjustment knob forces the rest arm to move laterally due to the threaded engagement between the shaft and the rest arm hole. Accordingly, with this embodiment, infinitely variable, incremental lateral adjustment of the rest arm is allowed.

The elevation adjustment screw passes through the base of the rest arm and engages a bottom plate of the assembly. Rotation of the adjustment screw raises or lowers the horizontal base, pivoting it about an axis defined by the shaft, which likewise angularly raises or lowers the arrow holding projection. Thus, incremental angular adjustment of the projection relative to the bow is provided. Accordingly, an archer may accurately compensate for tail winds, head winds and varying target distances by simply turning the elevation adjustment screw clockwise or counterclockwise to lower or raise the arrow trajectory, respectively.

In a second embodiment, the rest arm is defined just by an angularly upwardly extending projection that includes an aperture for receiving a securing screw. The lateral shaft is rotationally mounted transversely across the assembly and includes a substantially V-shaped slot that receives the securing screw. With this embodiment, the securing screw may be loosened to allow manual lateral adjustment of the rest arm to a desired position, whereupon the securing screw is tightened into the V-shaped slot. This provides an extremely tight and secure engagement between the shaft and the arm.

An angular elevational adjustment arm is attached to the mounting bracket on its side opposite the bow sidewall. The adjustment arm is likewise secured to the lateral shaft by a securing screw. The axis of the shaft defines a rotation axis for the adjustment arm. The angular elevation adjustment screw in this embodiment engages the adjustment arm. Rotation of the screw rotates the adjustment arm up or down which cooperatively rotates the lateral shaft carrying the rest arm. The rest arm is thus incrementally angularly adjusted relative to the bow in this manner.

Accordingly, it can be appreciated that the present invention allows an arrow to be steadily supported on a rest arm that is capable of both lateral and angular adjustment. An angular elevation adjustment screw allows infinitely variable, minute incremental adjustments to the angular position of the rest arm to allow the arrow to be precisely positioned for the proper flight trajectory. The components of the arrow rest assembly are constructed of lightweight, sturdy material such as aluminum or ABS plastic which is resistant to impact damage. Thus, the assembly is specifically adapted for long lasting use.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification illustrates several aspects of the present invention and together with the description serves to explain the principles of the invention. In the drawing.

Figure 1:
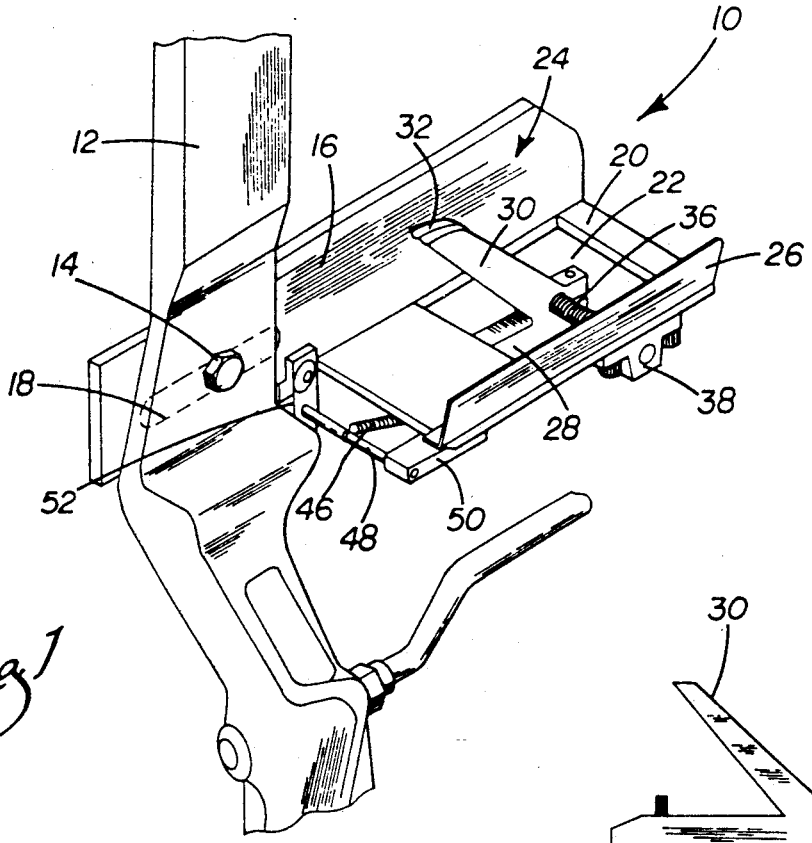
FIG. 1 is a perspective view of one embodiment of the present invention shown positionally mounted on a bow.

Reference will now be made in detail to the present preferred embodiment of the invention, an example of which is illustrated in the accompanying drawing.

DETAILED DESCRIPTION OF THE INVENTION

Reference is made to FIGS. 1–4 wherein is shown one preferred embodiment of an arrow rest assembly 10 according to the teachings of the present invention. As will be appreciated from a review of the following description in conjunction with the drawings, the arrow rest assembly 10 consistently and steadily supports an arrow in preparation for bowstring release while allowing for the appropriate positional adjustments in order to improve firing accuracy. The components of the assembly 10 are made of solid, sturdy materials in order to resist inadvertent impact forces and provide for long service life.

The arrow rest assembly 10 is adapted to be mounted to a bow 12 by means of a bolt 14. For this purpose, the assembly 10 includes a mounting bracket 16. The bracket 16 includes a longitudinal slot 18 that allows the assembly 10 to be longitudinally positioned relative to the bow 12. Accordingly, the arrow rest assembly 10 is adapted for use on bows of different sizes and manufacturers as well as by archers having a variety of draw spans.

The assembly 10 further includes a bottom plate 20. In this embodiment, the bottom plate 20 includes an opening 22 for receiving an operative portion of a rest arm 24 that will be further described below. A side plate 26 may be provided as a protective feature to reduce the opportunity of inadvertent striking of the rest arm 24. However, it will be appreciated from the following description that the side plate 26 is not required for the advantageous operation associated with the assembly.

Figure 4:
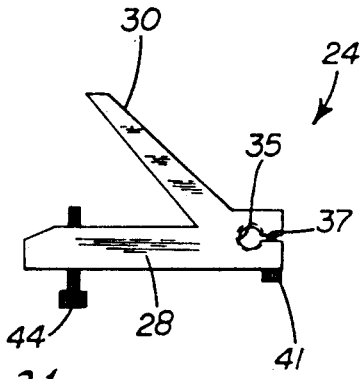
FIG. 4 is a side view of the rest arm used in the embodiment as shown in FIG. 1 of the present invention.
Figure 2:
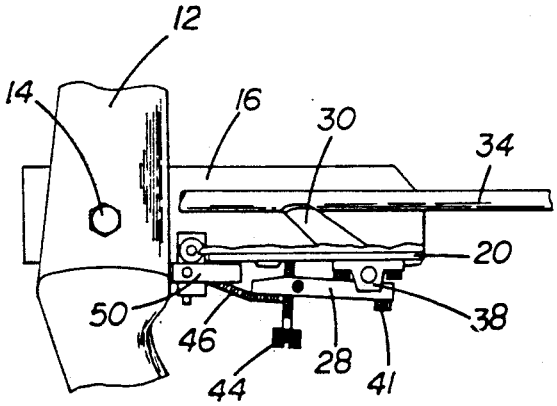
FIG. 2 is a partially broken away side view of the embodiment of the present invention as shown in FIG. 1, with the rest arm holding an arrow in preparation for firing.

As best shown in FIGS. 1, 2 and 4, the rest arm 24 includes a substantially horizontally extending base 28 and an angularly upwardly extending projection 30. The top edge of the finger 30 has a concave surface 32 for cooperatively engaging an arrow 34 (see particularly FIG. 3). The radius of the concave surface 32 is substantially the same as the radius of the arrow shaft 34. Thus, the rest arm 24 provides a steady, consistent support surface for the arrow 34 as it is being prepared for firing. The concave surface 32 further assists in improving accuracy by equally distributing the reactive forces imparted to the arrow 34 by the rest arm 24 upon release. This results in a more predictable arrow flight path than is possible with V-shaped rest arms that provide point contact as opposed to surface contact of the arrow 34.

The rest arm 24 further includes a threaded hole 35 at the convergence of the projection 30 and base 28 for receiving a spatially fixed, threaded lateral shaft 36. The hole 35 communicates with a spacing slot 37 that extends to the edge of the rest arm 24 opposite the base 28 and projection 30.

A securing screw 41 is received within the divided portions of the edge of the rest arm 24 that straddle the slot 37. Upon manipulation, the securing screw 41 acts to expand or contract the hole 35, thus adjusting the degree of engagement between the hole 35 and the shaft 36. It can be appreciated that upon tightening, the screw 41 generates tight operative engagement between the mating threads of the hole 35 and shaft 36, allowing lateral arm adjustment as described below.

The shaft 36 is mounted for relative rotation in opposing shaft mounting brackets 38, 40 at opposite ends of the bottom plate 20. As shown in the drawings, the shaft mounting brackets 38, 40 may be attached to the bottom plate 20 by set screws. The shaft mounting brackets 38, 40 thus allow relative rotation of the threaded shaft 36 but prevent any lateral movement.

An adjustment knob 42 (see FIG. 3) is attached to the shaft 36 on the side of the mounting bracket 16 opposite the sidewall of the bow 12. The knob 42 may be manipulated with the fingers to rotate the shaft 36. It can be appreciated that due to the spatial fixed positioning of the shaft 36 and threaded engagement between the shaft and rest arm 24, rotation of the shaft causes the rest arm to move laterally. Accordingly, selective, incremental lateral adjustment of the arm 24 on the shaft 36 relative to the bow 12 is provided by the design of the present invention. Thus, the archer may adjust the rest arm 24 laterally as required to accurately compensate for cross winds being experienced at any particular time.

Figure 3:
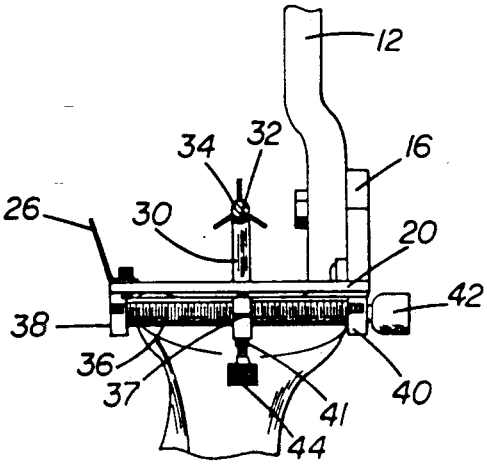
FIG. 3 is a rear view of the embodiment of the present invention as shown in FIG. 1, showing an arrow on the rest arm of the assembly in cross section.

In an important aspect of the invention, the assembly 10 includes an angular elevation adjustment screw 44. As best shown in FIGS. 2 and 4, the adjustment screw 44 is held for relative rotation within the horizontally extending base 28 of the arm 24. As best shown in FIGS. 2 and 3, the screw 44 engages the bottom surface of the bottom plate 20.

The threaded engagement between the screw 44 and the base 28 of the arm 24 provides for relative movement between the two. More particularly, as the screw 44 is rotated, the horizontal base 28 will be raised or lowered on the screw, pivoting about an axis defined by the lateral shaft 36. This action likewise angularly raises and lowers the projection 30 that holds the arrow 34. Accordingly, the adjustment screw 44 allows for angular positioning of the arm 24 and thus the arrow 34 prior to firing. Consequently, elevational or trajectory control is provided to allow an archer to compensate accurately for changes in target distance or even head and/or tail winds.

It can be appreciated that a slight change in the angular positioning of the arrow 34 results in a magnified difference in the impact point of the arrow 34 following release. This is especially important when aiming at a target at a substantial distance away from the archer. Thus, precision in angular positioning of the arrow 34 is very important in establishing firing accuracy. The angular elevation adjustment screw 44 allows minute incremental adjustments to be made during the angular positioning of the rest arm 24 and thus desirably assists in firing accuracy to an extent not possible with prior art arrow rest designs.

While the rest arm 24 provides a steady and consistent support seat for the arrow 34 in preparation for firing, it also responds advantageously when the arrow 34 is released. More specifically, it is typical for a bow 12 to have a nock set in the bowstring against which the nock of an arrow 34 is placed in preparation for firing. In general, the nock established is set at a position above the intersection of an imaginary horizontal line drawn from the arrow rest assembly 10 to the bowstring. Thus, upon release, the arrow 34 initially travels at an angle downward relative to the imaginary horizontal line. Accordingly, a downward force is imparted to the rest arm 24 as the archer releases the arrow 34 and sends it on its flight path. The rest arm 24 responds by deflecting away from the flight path substantially simultaneously with the release of the arrow 34. This action is allowed due to the relative rotational mounting of the shaft 36 carrying the arm 24 to the shaft mounting brackets 38, 40. Accordingly, the rest arm 24 does not impede the flight path of the arrow 34 by interfering with the fletching of the arrow 34 as it passes. This not only assists in maintaining shooting accuracy but also prevents damage to the fletching.

In order to return the rest arm 24 to the previously set support position, a biasing spring 46 is provided. A proximal end of the spring 46 is attached to the angular elevation adjustment screw 44 and under tension engages the bottom surface of the horizontal base 28 of the arm 24. As shown in FIG. 1, the distal end of the spring 46 is attached to a cross rod 48 that is mounted between rod mounting brackets 50, 52. In use, the biasing spring 46 operationally extends when the rest arm deflects down and away from the flight path of the arrow 34 upon release. The spring 46 then reactively responds by biasing the horizontal base 28 upwardly until the elevation adjustment screw 44 again engages the bottom plate 20. This positions the rest arm 24 in the previously set support position in preparation for firing a subsequent arrow 34. It can be appreciated that the rest arm 24 does not reach the support position until after the released arrow 34 has passed the rest arm position.

In operation, with the arrow rest assembly 10 mounted to the bow 12, the nock set described above is positioned on the bowstring, establishing the fixed relationship between the rear end of the arrow 34 and the bow 12. Then, adjustments are made to the rest arm 24 in response to the results of previous arrow firings to establish the relationship of the remainder of the arrow 34 relative to the bow 12. More specifically, adjustments are made laterally and angularly based oh the impact point of prior firings. It can be appreciated that the adjustments to the rest arm 24 may be made prior to placement of the arrow 34 on the surface 32 of the projection 30 or while the arrow 34 is sitting thereon. Lateral adjustments relative to the bow 12 to compensate for arrow drift due to cross winds are accomplished by rotating the adjustment knob 42 in the appropriate direction. Angular vertical adjustments to compensate for the distance to the target as well as head and tail winds are accomplished by rotating the elevation adjustment screw 44 in the appropriate direction. Through repeated manipulation of the knob 42 and the adjustment screw 44, incremental adjustment to place the arrow in the desired position for precise accuracy is accomplished.

A second embodiment of the present invention, generally denoted as 110, is shown in FIGS. 5–8. The assembly 110 is mounted in like manner to a bow 112 by a bolt 114. A mounting bracket 116 with a longitudinal slot 118 is provided for that purpose.

Figure 5:
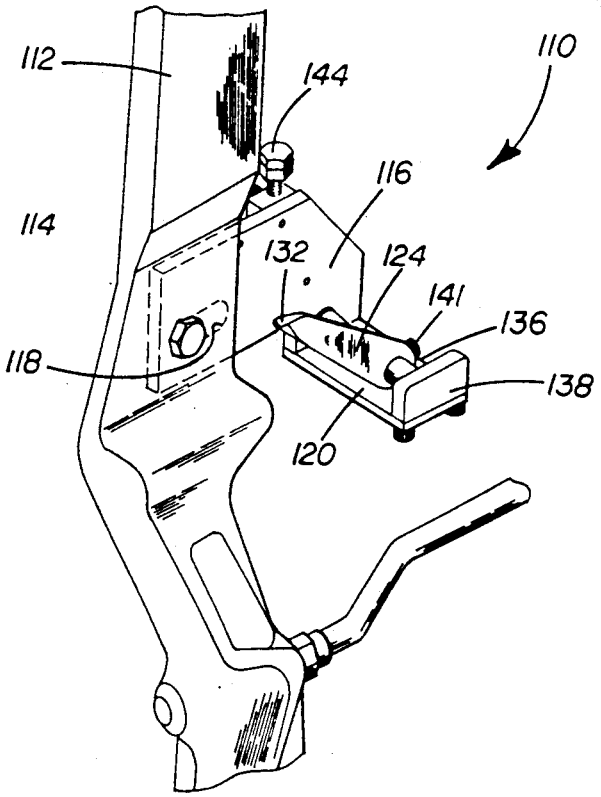
FIG. 5 is a perspective view of a second embodiment of the present invention shown mounted on a bow.
Figure 6:
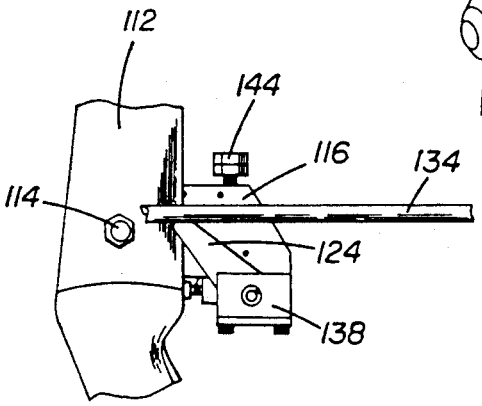
FIG. 6 is a right side view of the embodiment of the present invention as shown in FIG. 5, with the rest arm holding an arrow in preparation for firing.
Figure 7:
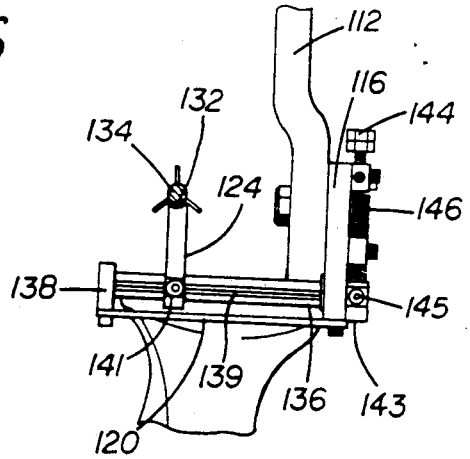
FIG. 7 is a rear view of the embodiment of the present invention as shown in FIG. 5, with an arrow on the rest arm of the assembly in cross section.

The assembly 112 includes a bottom plate 120. The bottom plate 120 may be attached to the mounting bracket 116 by set screws as shown in FIGS. 5 and 7. An angularly upwardly projecting rest arm 124 is provided for steady support of an arrow in preparation for firing. The rest arm 124 has a concave supporting surface 132 for providing surface contact when cooperatively holding an arrow 134 as best shown in FIG. 7.

A lateral shaft 136 is provided for positioning and supporting the rest arm 124. The shaft 136 is mounted for relative rotation between the mounting bracket 116 and an opposing shaft mounting bracket 138. FIG. 7 shows that the shaft mounting bracket 138 may be attached to the bottom plate 120 by set screws.

The shaft 136 includes a V-shaped slot 139 that assists in providing tight engagement between the rest arm 124 and the shaft 136. More particularly, the V-shaped slot 139 and the lateral shaft 136 are adapted to receive a securing screw 141. When lateral adjustment of the rest arm 124 is required, the securing screw 141 is loosened to allow manual sliding of the rest arm 124 along the shaft 136. Once the rest arm 124 is properly positioned as desired, the set screw 141 is tightened to secure the rest arm 124 in firm position. It can be appreciated that the set screw 141 can be fashioned with a V-shaped point to mate with the V-shaped slot 139 in the shaft 136, allowing very secure engagement between the components.

Figure 8:
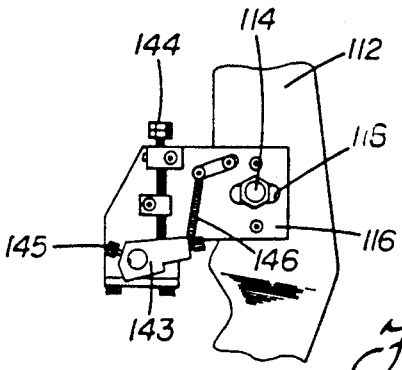
FIG. 8 is a left side view of the embodiment of the present invention as shown in FIG. 5, particularly showing the angular elevation adjustment arm and angular elevation adjustment screw.

In an important aspect of this embodiment, as best shown in FIG. 8, an angular elevation adjustment arm 143 is secured to a portion of the lateral shaft 136 that extends beyond the mounting bracket 116 opposite the sidewall of the bow 112. The adjustment arm 143 cooperates with an angular elevation adjustment screw 144 to provide incremental angular adjustment for the rest arm 124. More particularly, the adjustment arm 143 is fixed to the shaft 136 by a securing screw 145. As the adjustment screw 144 is rotated, the adjustment arm 143 rotates upwardly or downwardly in response about an axis defined by the shaft 136. This in turn causes the shaft 136 to rotate about its own axis. The rotational movement of the shaft 136 angularly raises or lowers the rest arm 124. Accordingly, incremental angular adjustment of the rest arm 124 is provided by this embodiment.

As with the first embodiment, upon release of the arrow 134, the associated forces urge the rest arm 124 downwardly away from the flight path of the arrow 124 and prevent damage to the fletching. A biasing spring 146 is provided to bias the rest arm 124 back to its previously established support position following each shot. More particularly, the spring 146 operationally expands when the rest arm 124 deflects downwardly away from the flight path of the arrow 134 upon firing. The cooperating engagement between the rest arm 124, the shaft 136 and the adjustment arm 143 transmits a like downward deflection to the adjustment arm 143. In response, the biasing spring 146 draws the adjustment arm 143 and thence the rest arm 124 back to the support position as established by the position of the angular elevation adjustment screw 144. The spring 146 may be attached to the adjustment arm 143 and the mounting bracket 116 by set screws or the like as shown in FIG. 8.

In summary, numerous benefits result from employing the concepts of the present invention. The arrow rest assembly 10, 110 provides positive support for an arrow 34, 134 in preparation for firing while also allowing the appropriate lateral and angular adjustments to ensure precise, accurate aiming. The elevation adjustment screw 44, 144 is particularly advantageous in providing selective, infinitely variable adjustment of the angular position of the rest arm 24, 124 supporting the arrow 34, 134. Accordingly, the trajectory of the arrow 34, 134 in flight can be more precisely directed and controlled. The arrow rest assembly 10, 110 is also fabricated of solid, impact-resistant materials for a sturdy construction and longer service life.

The foregoing description of a preferred embodiment of the invention has been presented for purposes of illustration or description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. An arrow rest assembly for use with a bow, comprising:

a bracket for mounting to said bow;

arm means for seating an arrow;

support means connected to said bracket for supporting and positioning said arm means;

means for laterally adjusting and securely positioning said arm means on said support means; and means for incrementally angularly adjusting the position of said arm means about a pivot axis coincident with the axis of said support means, said means for incrementally angular adjusting being set apart from said support means and being operable to cause angular displacement of said arm means during movement thereof, whereby said arrow is laterally positioned relative to said bow and its flight trajectory is established through incremental angular adjustment in preparation for shooting said arrow.

2. The arrow rest assembly of claim 1, wherein said incremental angular adjusting means comprises screw means.

3. The arrow rest assembly of claim 2 wherein said arm means includes a longitudinally projecting base for supporting said angular adjusting screw means and an angularly upwardly extending projection for seating said arrow.

4. The arrow rest assembly of claim 3, further including a bottom plate connected to said bracket and wherein said angular adjusting screw means includes a screw rotatably attached to said base of said arm means and adapted to engage against said bottom plate so that upon operative rotation of said screw, said projection of said arm means is angularly raised and lowered.

5. The arrow rest assembly of claim 4 further including a biasing spring cooperating with said arm means as it deflects away upon firing an arrow to bias said arm means back to an established arrow seating position following said firing.

6. The arrow rest assembly of claim 5, wherein said support means includes a spatially fixed threaded shaft that engages and mates with a threaded hole in said arm means.

7. The arrow rest assembly of claim 6, wherein said lateral adjusting means includes a rotatable adjustment knob cooperatively attached to said threaded shaft, whereby upon rotation of said knob said arm means is incrementally moved laterally relative to said bow due to its threaded engagement with said shaft.

8. The arrow rest assembly of claim 1, wherein said arm means includes an aperture for receiving a securing screw.

9. The arrow rest assembly of claim 8, wherein said support means includes a lateral shaft secured to said mounting bracket and having a slot therein for receiving said securing screw.

10. The arrow rest assembly of claim 10, wherein said slot is substantially V-shaped and said securing screw has a substantially V-shaped engaging end.

11. The arrow rest assembly of claim 10, wherein said incremental angular adjusting means comprises a screw means which cooperates with an adjustment arm adjustably fixed to said lateral shaft, whereby upon adjustment of said angular adjusting screw means, said arm means is angularly raised or lowered as said lateral shaft is rotated through its attachment to said adjustment arm.

12. The arrow rest assembly of claim 11, further including a biasing spring cooperating with said arm means as it deflects away upon firing an arrow to bias said arm means back to an established support position following said firing.

* * * * *